US005799878A

United States Patent [19]

Görde et al.

[11] Patent Number: 5,799,878

[45] Date of Patent: Sep. 1, 1998

[54] GAS MIXING NOZZLE FOR A CUTTING TORCH

[75] Inventors: Werner Görde, Fulda; Manfred Greifzu, Künzell, both of Germany

[73] Assignee: GCE-RHONA Autogengerate GmbH, Fulda, Germany

[21] Appl. No.: 672,539

[22] Filed: Jun. 28, 1996

[30] Foreign Application Priority Data

Jun. 28, 1995 [DE] Germany ..... 195 23 499.5

[51] Int. Cl.[6] ..... F23D 14/54

[52] U.S. Cl. ..... 239/419.3; 239/424.5

[58] Field of Search ..... 239/419, 419.3, 239/418, 423–425

[56] References Cited

U.S. PATENT DOCUMENTS 2,993,531 7/1961 Spies, Jr. ..... 158/27.4

5,114,121 5/1992 Arnout et al. ..... 266/48

FOREIGN PATENT DOCUMENTS 95290 6/1994 Austria .

0531196 3/1993 European Pat. Off. .

*Primary Examiner*—J. Casimer Jacyna

*Attorney, Agent, or Firm*—Baker & Botts, L.L.P.

[57] ABSTRACT

A nozzle for a cutting torch has three coaxial parts. An inner nozzle part includes an axial cutting duct, and machined longitudinal ducts for a fuel-gas/oxygen mixture which are open on the outside. The inner nozzle part is inserted into an outer nozzle part which radially delimits the longitudinal ducts. An annular mixer part is on a head region of the nozzle, radially delimiting the longitudinal ducts at the attachment to the outer nozzle part. The mixer part has radial bores which open as fuel gas passages into the longitudinal ducts which supply heating oxygen. The longitudinal ducts are through-machined from the mouth of the fuel gas passages to tapered regions of the inner and outer nozzle parts.

10 Claims, 3 Drawing Sheets

GAS MIXING NOZZLE FOR A CUTTING TORCH

BACKGROUND OF THE INVENTION

The invention relates to a nozzle or tip for a cutting torch and, more particularly, to a gas mixing nozzle or tip.

In a known gas mixing nozzle for a cutting torch, an axial duct, peripheral ducts for a fuel-gas/heating-oxygen mixture which surround the axial duct, and upstream mixing stations in which fuel gas ducts meet ducts for heating oxygen are made by machining a work piece. The fuel gas and heating oxygen ducts extend obliquely inward over a considerable distance in the work piece. The diameters of the peripheral ducts and of the ducts for heating oxygen vary along the flow direction. The manufacture of such a nozzle requires several working steps on different machine tools, requiring clamping and reclamping the work piece. This limits the accuracy with which the nozzle can be made, and ultimately limits the cutting accuracy of a torch. Particularly involved is the forging step which is required for realizing the desired bore geometry.

A gas mixing nozzle for a cutting torch of the above-mentioned type and including three or more machined parts is disclosed in U.S. Pat. No. 2,993,531. It is not suitable for mixing heating oxygen and acetylene, which form a highly combustible gas mixture, but is designed only for mixing oxygen with propane or a similar fuel gas, i.e., for slow-burning gas mixtures. In this known nozzle, an inner machined part is formed as an inner nozzle with the cutting duct on the outside. In sequence in the direction of gas flow, the inner part has an annular, relatively wide first duct, a collar contiguous therewith, a second relatively wide annular duct, and a further section of larger diameter. The latter section is smooth and cylindrical on the outside, and leads to individual longitudinal ducts which run on the outside over a section of the inner part that tapers toward its lower end. The second duct forms an expansion chamber in communication with a smooth, cylindrical inner wall of a second machined part into which the first part is inserted. The gas mixing nozzle is completed by a seating ring or by a pair of seating ring parts which are pushed over the top end of the first part, which has machined longitudinal ducts forming metering ducts for the cutting oxygen. The fuel gas, such as propane, is fed to these metering ducts via an annular groove in the single seating ring, or between the two seating ring parts. The longitudinal ducts are made by reaming. Forming the annular ducts requires different machining steps, so that the first part is difficult to make. Moreover, this nozzle lacks adequate flashback safety for operation with acetylene or similar highly combustible fuel gases. If this prior-art nozzle were to be operated with an acetylene-oxygen gas mixture, it would soon be destroyed because of the geometry of the longitudinal ducts and the large space between the outer and inner nozzles.

SUMMARY OF THE INVENTION

It is an object of the present invention to provide a gas mixing nozzle for a cutting torch that can be manufactured easily and reproducibly, so that the cutting torch meets high standards of flashback safety especially when acetylene/oxygen or another highly combustible fuel-gas/oxygen mixture is used, and that has a long life expectancy.

Without circumferential ducts, a preferred nozzle is readily made to meet the high standards of flashback safety for use of acetylene.

More specifically in a preferred embodiment with high flashback safety, longitudinal ducts for a fuel-gas/heating-oxygen mixture merge into ducts for heating oxygen at a point upstream from the mouth of the fuel gas passage. Conveniently, such ducts can be made by through-machining.

Preferably further, for use of acetylene or other highly combustible fuel gas, the nozzle can be formed so that a cutting duct in a first machined part ends at the same height as a second, surrounding machined part. The cutting duct and the longitudinal ducts for the fuel-gas/heating-oxygen mixture of the first part can be produced with especially high accuracy, without unclamping and reclamping the first part. Advantageous in this respect is the fact that the ducts for the fuel-gas/heating-oxygen mixture are open on the outside of the first part, so that they can be machined easily without reclamping after drilling of the axial cutting duct and of a cutting-oxygen duct that merges into the cutting duct. The second part, in the form of a sleeve, closes off the longitudinal ducts for the fuel-gas/heating-oxygen mixture when the first part is inserted into the second part.

A third machined part is ring shaped. When installed on the first part, its axial bore delimits the longitudinal ducts of the fuel-gas/oxygen mixture, at the point of attachment to the second part. The third part serves as a mixer and has oblique, nearly radial bores which open into the longitudinal ducts for the fuel-gas/heating-oxygen mixture. The first part has a sealing seat for the cutting oxygen, and the second part has centered sealing seats for heating oxygen and fuel gas. The sealing seats are approximately frustum-shaped and can be manufactured by turning on a lathe.

Preferably, the first part is formed with a taper as a frustum in its lower region. An axial bore in the second part is tapered correspondingly, so that the longitudinal ducts for the fuel-gas/heating-oxygen mixture are directed inward. The resulting highly accurate longitudinal ducts for the fuel-gas/heating-oxygen mixture facilitate accurate adjustment of the flame. The second part can have an external downward-tapered frustum region with known benefits.

A cutting oxygen duct in the first part can merge via a downward-tapered frustum section into the lower cutting duct. Such a duct can be machined under numerical control, without reclamping the first part.

The second part, to which the third or mixer part is attached as described above, can have an upper flange on which the third part is seated in co-planar relationship. Thus, the longitudinal ducts of the fuel-gas/heating-oxygen mixture are reliably sealed at their outside ends at the abutting face between the second and third parts. The upper flange of the second part can also have a retaining function for attachment of the nozzle to a fuel gas line.

Advantageously, the parts can be made of copper, which is readily machinable.

DETAILED DESCRIPTION OF PREFERRED EMBODIMENTS

Figure 4:
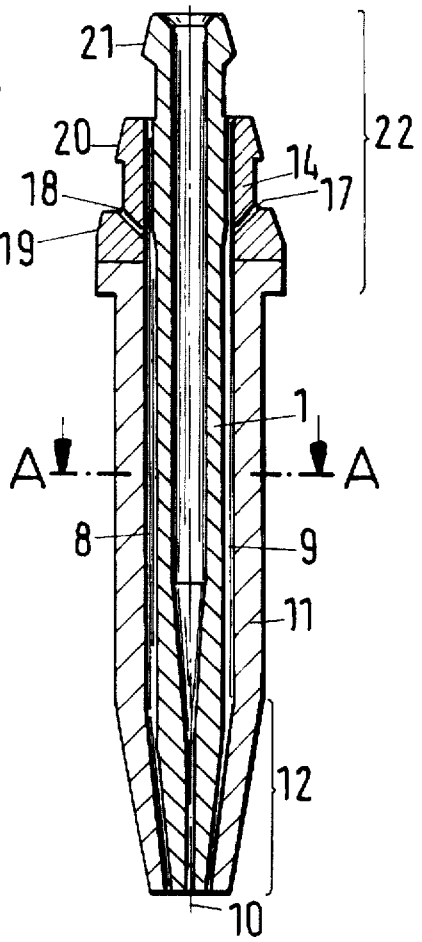
FIG. 4 is a side view of a nozzle for a cutting torch, consisting of the three parts according to FIGS. 1, 2 and 3.

The figures show a first, inner-nozzle part 1. Its shape is approximately cylindrical and having a frustum section 2 in its lower region 3. The first part has an internal axial cutting duct 4 into which a cutting oxygen duct 5 merges via a frustum section 6. At the top, the first part ends in a sealing seat 7.

Figure 5:
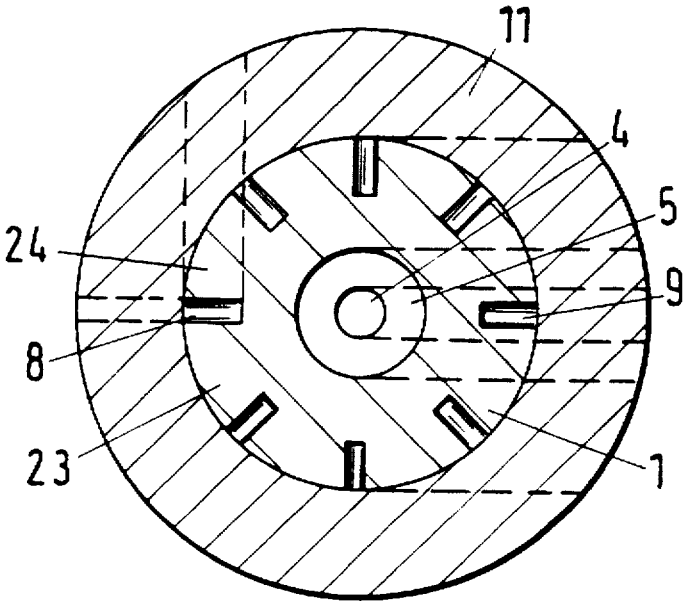
FIG. 5 is a cross section, enlarged, through the nozzle at the plane A—A of FIG. 4.

Machined longitudinal ducts, e.g., 8 and 9 for the fuel-gas/heating-oxygen mixture are on the outer side of the first part 1, which ducts are open in a radial direction outward. They run substantially parallel to the longitudinal axis 10 of the first part, which axis is also the longitudinal axis of the assembled nozzle as shown FIG. 4. But in the lower region 3 they are angled inward and downward, corresponding to the outside of the frustum section 2. FIG. 5 shows the longitudinal ducts in cross section, evenly distributed on the circumference of part 1, as radially machined and open toward the outside.

The longitudinal ducts, e.g., 8 and 9 are closed off outside by the second part 11, which is also substantially cylindrical and also has a frustum lower region 12. The second part has an axial inner bore 13 which is substantially cylindrical and which, in the lower region 12, tapers as a frustum analogous to the lower region of the first part. When the first part is inserted into the second part as shown in FIGS. 4 and 5, ridges such as 23 and 24 between the longitudinal ducts for the fuel-gas/heating-oxygen mixture lie along the inner bore, whereby the first part 1 is coaxially aligned in the second part 11.

Figure 3:
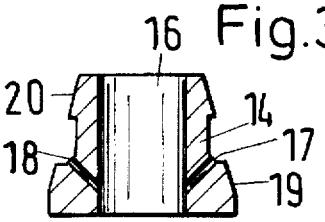
FIG. 3 is a longitudinal section through a third machined part forming the mixer.
Figure 2:
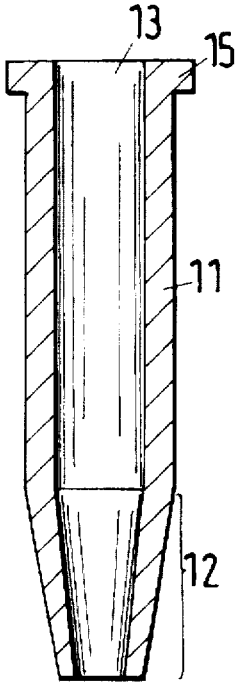
FIG. 2 is a longitudinal section through a second machined part forming the outer nozzle.

The third part 14, shown in FIG. 3, is approximately annular. In assembly it is attached at the top of the second part. It is placed on an upper flange 15 of the second part, with co-planar upper and lower contacting faces on the upper flange 15 and the part 14, respectively. Thus, the longitudinal ducts, which lead into an inner bore 16 of the third part, here also are sealed on their outside. Sunk obliquely into the third part are radial bores, e.g., 17 and 18 which open into the longitudinal ducts in the assembled nozzle.

Fuel gas, such as acetylene, is supplied to these bores 17, 18 via an attachment that is sealed at a sealing seat 19 of the third part. Upstream of the bores 17, 18, heating oxygen supplied via an attachment (not shown) on a sealing seat 20 of the third part enters the longitudinal ducts 8, 9 which here serve as ducts for heating oxygen only. Cutting oxygen is introduced into the cutting oxygen duct 5 via an attachment (not shown) sealed to a sealing seat 21 on the first part. The sealing seats 19, 20 and 21 are disposed centered in the top region 22 of the assembled nozzle.

Advantageously, the resulting nozzle can be used with acetylene as fuel gas. It can be manufactured at low cost and with high accuracy especially with respect to the cutting duct 4 and the longitudinal ducts 8, 9. As a result, the accuracy of cuts made with a cutting torch including the nozzle is high.

Figure 1:
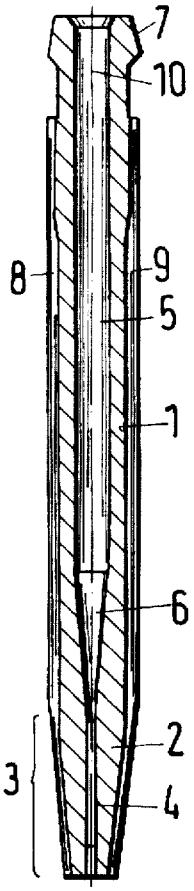
FIG. 1 is a longitudinal section through a part machined as the inner nozzle.
Figure 6:
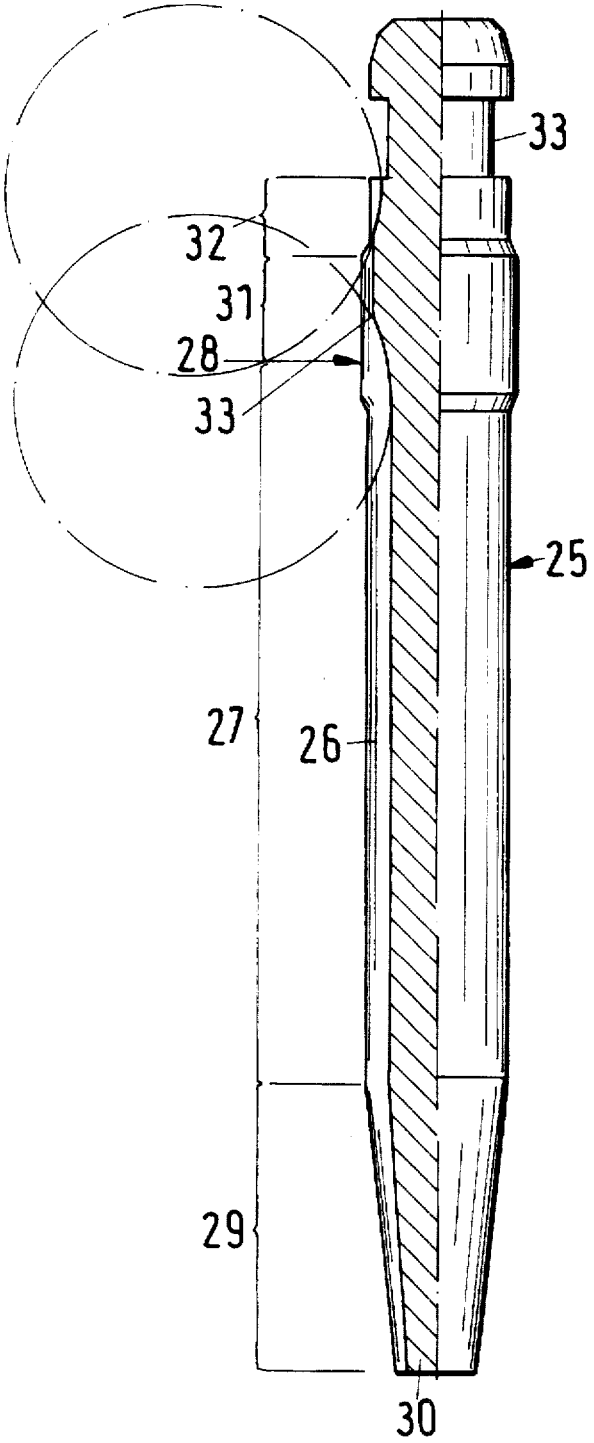
FIG. 6 is a longitudinal partial section through a variant of the first part.

In FIG. 6, a variant 25 of the first part of FIGS. 1 and 4 is shown without the axial cutting or cutting-oxygen duct. FIG. 6 shows a longitudinal duct 26 for the fuel-gas/heating-oxygen mixture in further detail. Like the other longitudinal ducts distributed on the circumference, the duct 26 has constant, greater depth in the region 27 which lies between (i) the mouth of a fuel gas passage consisting of the approximately radial bores 17, 18 in the third part 14 shown in FIGS. 3 and 4 and indicated by an arrow 28 in FIG. 6, and (ii) the lower region 29, in which the first part tapers; as contrasted with the lower region 29 as well as with regions upstream from the mouth of the fuel gas passage at the arrow 28. In the lower region 29 of the first part, the longitudinal duct 26 tapers from the depth in region 27 to a minimum depth at the lower end 30. In region 27, the longitudinal duct 26 represents a mixing duct.

Upstream of the region 27, the longitudinal duct 26 has a curved bottom as shown in FIG. 6, so that the depth of the longitudinal duct decreases to a lesser depth in the section 31 of the longitudinal duct 26. In a contiguous upstream section 32, the depth of the longitudinal duct 26 again increases as shown in FIG. 6. In the second section 32 and in a subsection of constant flow duct depth in the first section 31, this duct forms a metering duct for the heating oxygen which is fed in at the slot 33. Acetylene fuel gas is supplied with the third part 14 of FIGS. 3 and 4, via its approximately radial bores 18, 19. These bores run approximately parallel to the bottom curve 33 of the longitudinal duct 26, with duct depth decreasing from greater to lesser depth upstream from the mouth of the approximately radial bore 18 shown in FIG. 3. Thus, acetylene fuel gas flows into the heating oxygen nearly tangential to the bottom of the longitudinal duct 26 and becomes thoroughly mixed with the oxygen.

We claim:

1. A gas mixing nozzle for a cutting torch, comprising in coaxial alignment:

a first, axially elongated part (1, 25) having a substantially cylindrical lateral surface and a tapered region (3, 12, 29), an axial cutting duct (4), peripheral longitudinal ducts (8, 9, 26) disposed at the lateral surface, and a sealing seat (7) for a cutting oxygen connection;

a second, axially elongated part (11) having an axial inner bore (13) into which a major portion of the first part is inserted and which radially delimits a major portion of the longitudinal ducts (8, 9, 26) of the first part (1, 25); and a third, annular part (14) disposed on the second part and with a minor portion of the first part (1, 25) disposed in the annular opening, radially delimiting a minor portion of the longitudinal ducts (8, 9, 26) of the first part (1, 25), having at least one fuel gas passage into at least one of the longitudinal ducts (8, 9), and having centered sealing seats (19, 20) for a fuel gas connection and a heating oxygen connection, respectively;

wherein:

the longitudinal ducts (8, 9, 26) extend at least from a mouth (at 28) of the fuel gas passage to the tapered region (3, 12, 29);

the heating oxygen connection is upstream from the mouth of the fuel gas passage;

the longitudinal ducts (8, 9, 26) have a constant depth between the mouth (at 28) of the fuel gas passage and the tapered region (3, 12, 29), which depth is greater than duct depth in the tapered region (3, 12, 29);

the first part has a region (31) upstream of the mouth (at 28) of the fuel gas passage, wherein the longitudinal ducts (8, 9, 26) have a circular arc profile which meets the region of constant depth tangentially, and wherein duct depth decreases upstream to a lesser depth than the constant depth.

2. The gas mixing nozzle according to claim 1, wherein the first part (1, 25) has a frustum-shaped lower region (3, 29), with the axial inner bore (13) being tapered correspondingly and such that the longitudinal ducts (8, 9, 26) are directed downward and inward.

3. The gas mixing nozzle according to claim 2, wherein the second part (11) has an external frustum region (12).

4. The gas mixing nozzle according to claim 1, wherein the first part (1, 25) has a frustum section (6) with the cutting duct (4) disposed therein, and an axial cutting oxygen duct (5) merging into the cutting duct (4).

5. The gas mixing nozzle of claim 1, wherein the second part has a flange (15) on which the third part (14) is disposed in co-planar relationship.

6. The gas mixing nozzle according to claim 1, wherein the first, second and third parts (1, 11, 14) consist of copper.

7. The gas mixing nozzle according to claim 1, wherein the third part (14) has radial bores (17, 18) which open into the longitudinal ducts (8, 9, 26).

8. The gas mixing nozzle according to claim 7, wherein each of the radial bores (17, 18) is substantially parallel to a bottom curve of its corresponding one of the longitudinal ducts (26) in the upstream region (31).

9. The gas mixing nozzle according to claim 1, wherein the first part has a region (32) further upstream of the upstream region (31), and wherein the longitudinal ducts (8, 9, 26) have increased depth in the further upstream region (32) as compared with depth in the upstream region (31).

10. The gas mixing nozzle according to claim 1, wherein the cutting duct (4) terminates at the same height as the second part (11).

* * * * *